US008336215B2

(12) United States Patent
Hoshiyama

(10) Patent No.: US 8,336,215 B2
(45) Date of Patent: Dec. 25, 2012

(54) IMAGE CARD, IMAGE ENGRAVING DEVICE AND IMAGE ENGRAVING METHOD

(75) Inventor: Yuichi Hoshiyama, Chuo-ku (JP)

(73) Assignee: Semco Corporation, Tokyo (JP)

( * ) Notice: Subject to any disclaimer, the term of this patent is extended or adjusted under 35 U.S.C. 154(b) by 319 days.

(21) Appl. No.: 12/743,320

(22) PCT Filed: Nov. 17, 2008

(86) PCT No.: PCT/JP2008/003348
§ 371 (c)(1),
(2), (4) Date: May 17, 2010

(87) PCT Pub. No.: WO2009/063650
PCT Pub. Date: May 22, 2009

(65) Prior Publication Data

US 2010/0260973 A1 Oct. 14, 2010

(30) Foreign Application Priority Data

Nov. 16, 2007 (JP) ..... P2007-298385
Nov. 16, 2007 (JP) ..... P2007-298386

(51) Int. Cl.
*B43L 13/02* (2006.01)

(52) U.S. Cl. ..... 33/32.4; 33/18.1; 33/41.1

(58) Field of Classification Search ..... 33/1 M, 33/18.1, 19.1, 19.2, 32.1, 32.2, 32.3, 32.4, 33/32.5, 32.6, 41.1, 41.4, 45
See application file for complete search history.

(56) References Cited

U.S. PATENT DOCUMENTS 3,827,468 A * 8/1974 Markham ..... 33/32.3
6,640,452 B1 * 11/2003 Bieg ..... 33/1 M
2005/0086816 A1 * 4/2005 Siegel ..... 33/18.1
2007/0180715 A1 * 8/2007 Nishio ..... 33/18.1
2009/0308219 A1 * 12/2009 Yamamoto et al. ..... 33/32.3
2012/0000081 A1 * 1/2012 Kawaguchi et al. ..... 33/18.1

FOREIGN PATENT DOCUMENTS

| | | |
|---|---|---|
| JP | 61-280936 | 12/1986 |
| JP | 63-178098 | 7/1988 |
| JP | 05-024394 | 2/1993 |
| JP | 10-297077 | 11/1998 |
| JP | 2002-154262 | 5/2002 |
| JP | 2003-191697 | 7/2003 |
| JP | 2007-118395 | 5/2007 |
| JP | 2007-130855 | 5/2007 |

* cited by examiner

*Primary Examiner* — G. Bradley Bennett
(74) *Attorney, Agent, or Firm* — Jordan and Hamburg LLP

(57) ABSTRACT

In an image card where an image is formed on a thin plate made of special synthetic paper or plastic by engraving by sweeping the plate with the engraving needle through relative movement of an engraving needle and a plate, it is impossible to form a hidden image which can be viewed when a viewpoint is changed or form an image formed by watermark engraving and the hidden image within the same plane. A hidden image is formed on an image card by engraving while angles of stripes of striped patterns are changed in response to shading of an image. Further, an image engraving device is provided with a rotary driving unit, and engraving is performed in a state that an extending direction of striped grooves of the hidden image and a forming direction of the engraving are made equal, so that a wall face of a groove is always formed by the same side face of an engraving needle and undulation does not occur on the wall face of the groove. Similarly, a shape of a bottom face of the groove is made even. As a result, precision of the hidden image is made high and an effect as the hidden image is further improved.

4 Claims, 7 Drawing Sheets

IMAGE CARD, IMAGE ENGRAVING DEVICE AND IMAGE ENGRAVING METHOD

BACKGROUND OF THE INVENTION

1. Field of the Invention

The present invention relates to an image card an image formed on a card base that is made of paper or plastic by engraving, image engraving device and image engraving method. In particular, the present invention relates to image card an image watermark-engraved by changing the thickness of the card according to a scraping-out amount and a hidden image laid on the watermark-engraved image and engraved by means of making angles of striped grooves within the card plane different, the engraved device and the engraved method capable of forming the hidden image.

2. Description of Related Art

There is an image engraving device which performs engraving on a thin plate made of paper or plastic by sweeping the plate with the engraving needle through relative movement between an engraving needle and a plate (an image card) (see Patent Literature 1). In the image engraving device, a plate to be engraved attached to a base stand (supporting stand) is reciprocated in a horizontal direction, and the engraving needle lowered in a vertical direction is brought into contact with the plate to be engraved to engrave a surface thereof so that watermark engraving is performed while changing a thickness direction of the plate to be engraved.

The plate to be engraved (image card) which has been watermark-engraved in this manner is used as a person authentication card or a security sheet for an important document (see Patent Literatures 2 and 3). For the image cards used as documents for security, there is a technical demand for showing validities of the image cards by embedding hidden images in the image cards, but there is not been any method for forming a hidden image by the engraving so far.

As the conventional art, there is a method for distinguishing an original printed matter from a copy thereof from each other by printing parallel line patterns, which are striped patterns, arranged at different angles on the printed matter (see Patent Literature 4), but there is neither a method for embedding a hidden image using a cubic shape obtained from an engraved matter nor a method for forming a hidden image and a watermark-engraving within the same plane in combination.

In view of these circumstances, it is possible to embed a hidden image by forming striped grooves with different angles, but undulations appear on wall faces of stripes according to angles of striped grooves in such a conventional image engraving device as shown in Patent Literature 1. Differences due to the stripe angles appear due to the differences of the angles of the striped grooves when the hidden image is observed on plane from above, which results in such a problem that the image does not configure a hidden image.

Patent Literature 1: Japanese Patent Application Laid-Open Publication No. 05-024394

Patent Literature 2: Japanese Unexamined Patent Application Publication No. 2007-118395

Patent Literature 3: Japanese Unexamined Patent Application No. 2007-130855

Patent Literature 4: Japanese Patent Application Laid-Open Publication No. 10-297077

SUMMARY OF THE INVENTION

A problem to be solved lies in the point that a hidden image cannot be formed on an image card formed by engraving or an image formed by watermark engraving and the hidden image cannot be formed within the same plane and a point that wall faces of striped grooves cannot be engraved on the image card with a high degree of accuracy when a hidden image is formed using striped grooves whose angles are made different.

MEANS FOR SOLVING THE PROBLEM

An image card of the present invention is mainly characterized by an image card having an image formed on a card base made of paper or plastic by engraving, the image is formed by engraving striped grooves having different angles according to the degree of shading of the image by the engraving.

Further, the image card of the present invention is the abovementioned image card, wherein the shading of the image is expressed by binary and the image is formed by expressing the shading of the binary with striped grooves orthogonal to each other.

Moreover, the image card of the present invention is the abovementioned image card, wherein the card base for the card has a structure including at least two layers in which one is a transparent layer which is transparent and an opaque layer which is opaque, the engraving is performed from the side of the opaque layer, and the striped grooves reach the transparent layer by scraping off the opaque layer.

Further, the image card of the present invention is the abovementioned image card, wherein a watermark-engraved image is formed by changing the thickness of a layer remaining after the engraving according to the degree of shading of the image, and the image formed by the striped grooves and the image formed by the watermark-engraved are formed on the same plane.

An image engraving device of the present invention is an image engraving device including an engraving needle driving unit driving an engraving needle in a vertical direction and a plate driving unit driving a plate to be engraved in a horizontal direction to perform engraving on the plate by sweeping the plate with the engraving needle through relative movement between the engraving needle and the plate to be engraved, wherein the image engraving device includes a rotary driving unit, which rotates the plate to be engraved in a horizontal direction, and forms striped grooves by performing engraving on the plate to be engraved which has been rotated to a given angle by sweeping the plate with the engraving needle.

An image engraving method of the present invention is an image engraving method which performs engraving using an image engraving device which including engraving needle driving means driving an engraving needle in a vertical direction and a plate driving means driving a plate to be engraved in a horizontal direction to perform engraving on the plate by sweeping the plate with the engraving needle through relative movement between the engraving needle and the plate, wherein the image engraving device includes rotating the plate in a horizontal direction and the method rotates the plate at a given angle by the rotary driving means and forms striped grooves by performing engraving the rotated plate by sweeping the plate with the engraving needle.

Since the image card of the present invention is the image card having an image is formed by performing engraving on a card made of paper or plastic, wherein the image is formed by forming striped grooves whose angles are made different in response to the degree of shading of the image by the engraving, it is possible to embed a hidden image which appears when the image card is observed from a view point on an angle parallel to the striped grooves in an oblique direction of the image card.

Furthermore, since the image card of the present invention is the abovementioned image card, wherein the shading of the image is expressed by binary and the image is formed by expressing the shading of the binary with striped grooves orthogonal to each other, it is possible to embed a hidden image with binary shading which is high in contrast.

Moreover, since the image card of the present invention is the abovementioned image card, wherein the card base for the card has a structure including at least two layers in which one is a transparent layer which is transparent and an opaque layer which is opaque, the engraving is performed from the side of the opaque layer, and the striped grooves reach the transparent layer by scraping off the opaque layer, a hidden image can be observed even from the back side of an engraved face of the image card, so that an image card where the contrast of shading of the hidden image is very high can be obtained.

Further, since the image card of the present invention is the abovementioned image card, wherein a watermark-engraved image is formed by changing the thickness of a layer remaining after the engraving according to the degree of shading of the image, and the image formed by the striped grooves and the image formed by the watermark-engraved image are formed on the same plane, it is possible to cause a hidden image and a watermark-engraving to exist on the same plane in a mixing manner, so that a hiding effect of the hidden image becomes higher because attention is paid to the watermark-engraved image.

Since the image engraving device of the present invention is an image engraving device which includes an engraving needle driving unit driving an engraving needle in a vertical direction and a plate driving unit driving a plate to be engraved in a horizontal direction to perform engraving to the plate by sweeping the plate with the engraving needle through relative movement between the engraving needle and the plate, the apparatus further comprising a rotary driving unit rotating the plate in a horizontal direction to form striped grooves by engraving on the plate rotated at a given angle by sweeping the plate with the engraving needle, when a hidden image is formed by performing engraving so as to make angles of striped grooves different, undulations which are to occur on wall faces of the striped grooves are prevented from occurring by causing the angle of the engraved grooves to coincide with an engraving direction, so that it is possible to perform engraving of striped grooves with high accuracy. This results in forming the hidden image effectively.

Since the image engraving method of the present invention is the image engraving method which performs engraving using an image engraving device which including engraving needle driving an engraving needle in a vertical direction a driving means a plate to be engraved in a horizontal direction and which performs engraving on the plate by sweeping the plate with the engraving needle through relative movement between the engraving needle and the plate wherein the image engraving device includes rotary driving means rotating the plate in a horizontal direction, and forms striped grooves by is formed on the rotated plate performing engraving on the plate rotates at a given angle by the rotationally driving by sweeping the plate with the engraving needle, when a hidden image is formed by performing engraving so as to make angles of striped grooves different, undulations which are to occur on wall faces of the striped grooves are prevented from occurring by causing the angle of the engraved grooves to coincide with an engraving direction, so that it is possible to perform engraving of striped grooves with high accuracy. This results in forming the hidden image effectively.

DETAILED DESCRIPTION OF EMBODIMENTS

An image card of the present invention has solved such a problem that a hidden image cannot be embedded in the image card by means of engraving striped patterns while making angles of the striped patterns different according to shading of an image. Further, an image engraving device of the present invention has solved such a problem that, when a hidden image is are on the other engraved image striped grooves whose angles are made different, shapes of the grooves are varied according to the angles, by providing the image engraving device with a rotary driving unit for causing directions of the grooves and an engraving direction to coincide with each other.

An image card composed of an opaque layer will be first explained as a first embodiment of the present invention.

Figure 1:
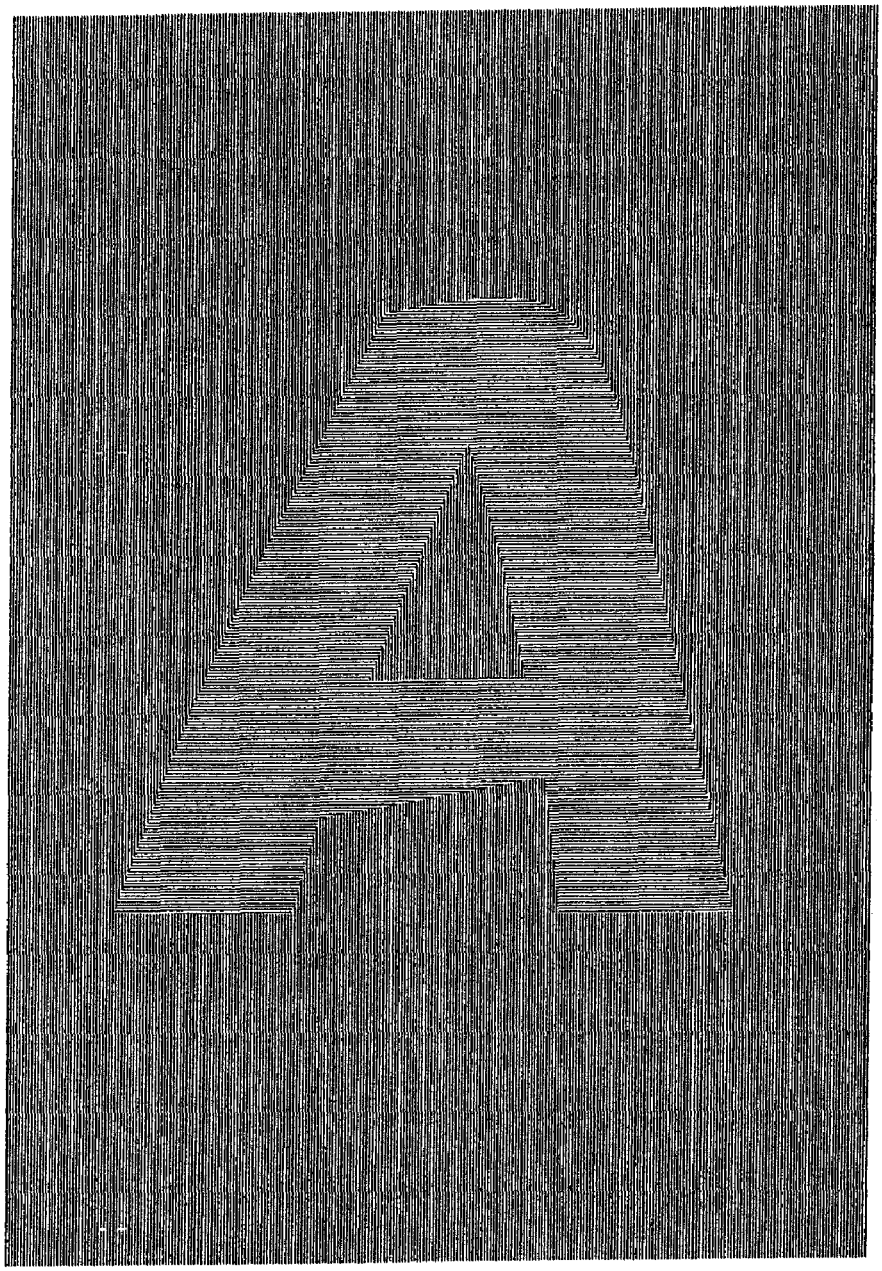
FIG. 1 shows an example of an image formed by striped grooves which are engraved on an image card according to first to third embodiments of the present invention

FIG. 1 shows an example of the image card of an embodiment of the present invention as viewed from the above.

FIG. 1 is a view of an image of an alphabetical character "A", a character portion of which is a striped pattern formed by striped grooves in horizontal direction and a non-character portion of which is formed by a striped pattern extending in vertical direction. Since the striped pattern extending in horizontal direction and the striped pattern in vertical direction are formed such that their line widths are equal to each other and their distances between adjacent lines are equal to each other, image concentrations thereof are the same. When the image is viewed from a position separated by a distance where a line pattern of the image is vague, it becomes difficult to determine what pattern is written on the image.

In practice, the image engraving device can perform engraving to form ten lines within a width of 1 mm. Therefore, an image obtained by the image engraving device is such a fine image that the width of a rectangle shown in FIG. 1 falls within 13 mm, and it is difficult to recognize the image of the character "A" with naked eyes from above, so that the obtained image configures a hidden image.

However, it becomes possible to determine the character when the image is observed from directions parallel to the respective striped patterns in oblique directions.

Figure 2:
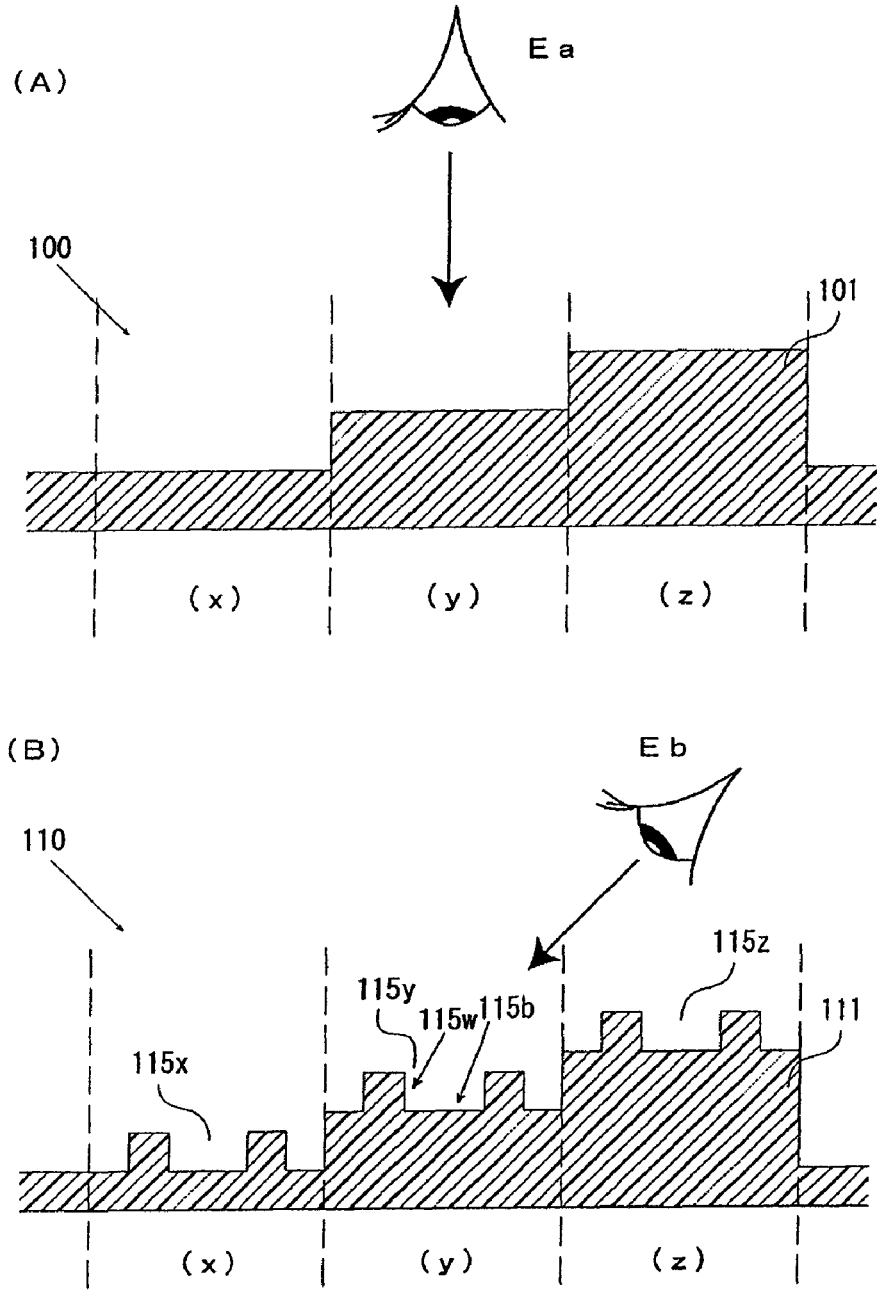
FIGS. 2(A) and 2(B) are sectional views of a conventional image card (FIG. 2A) and an image card according to the first embodiment (FIG. 2B) as viewed from their engraved faces.

FIG. 2A is an enlarged view of a section of an image card 100 which has been watermark-engraved by engraving according to a conventional art. The image card 100 is entirely formed of an opaque layer 101. The formation is made by engraving such that respective sections shown by (x), (y) and (z) in FIG. 2A are different in thickness from one another. When the image is viewed from a viewpoint Ea in FIG. 2A, since intensities of transmitted lights are different according to thicknesses of the respective sections, an image whose concentration becomes deeper in the order of the sections indicated by (x), (y) and (z) is formed.

FIG. 2B is a view of an example of formed by combining striped grooves of an embodiment of the present invention with the watermark-engraving of the conventional art.

The image card 110 is entirely composed of an opaque layer 111, where striped grooves 115*x*, 115*y* and 115*z* are formed so as to extend from the front side of the sheet in a depth direction of the sheet. When these grooves are observed from a viewpoint Eb perpendicular to an extending direction of the grooves, wall faces 115*w* of the striped grooves are mainly observed. Further, when the grooves are observed from a viewpoint (a position above the sheet) parallel to the extending direction of the grooves, the whole light passes through a transparent layer. Therefore, since contrast varies according to the viewpoint direction, an image is formed according to directions of the striped grooves.

Figure 3:
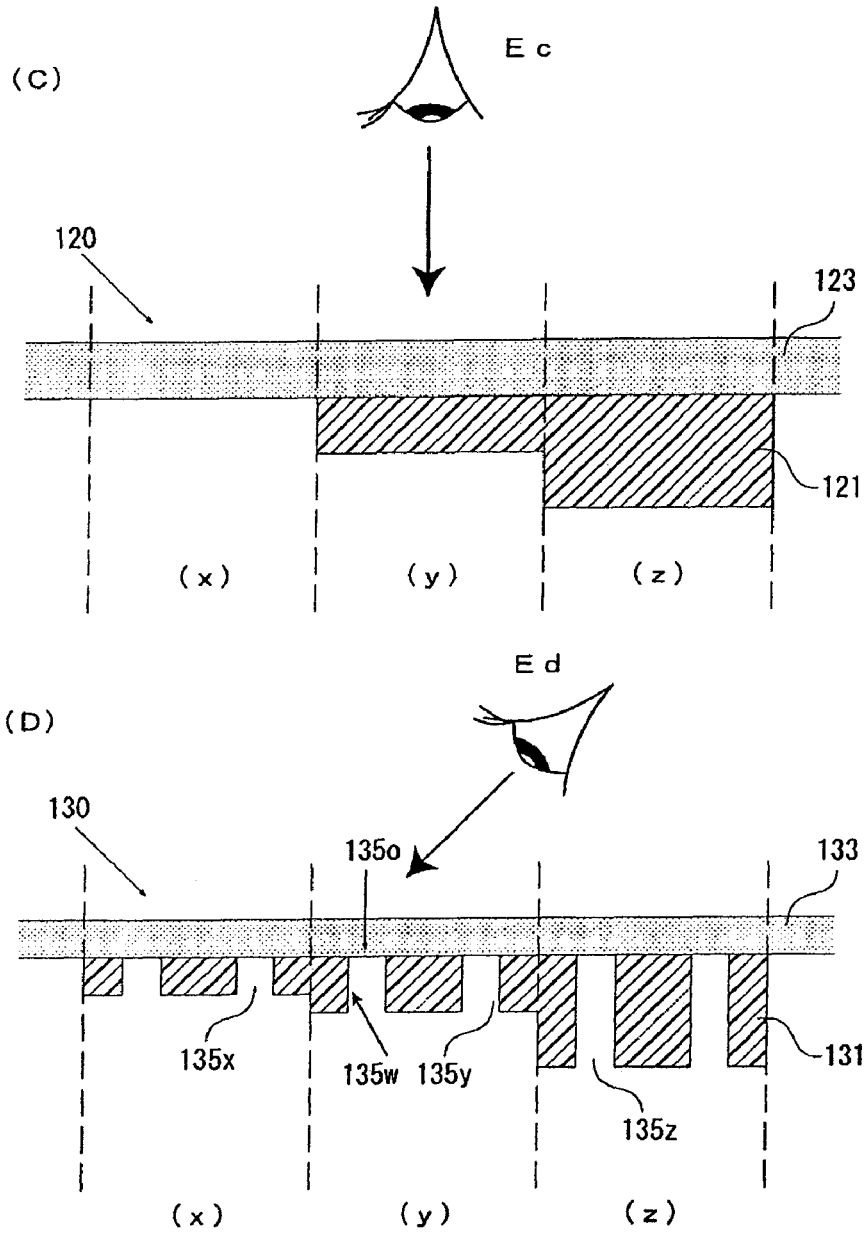
FIGS. 3(C) and 3(D) are sectional views of a conventional image card (FIG. 3C) and an image card according to the second embodiment (FIG. 3D) as viewed from opposite faces to the engraved faces.

Regarding a watermark-engraved image shown in FIG. 3D, concentration thereof is determined according to an average value of areas of grooves in height directions thereof like the first embodiment. Since the widths of the grooves themselves are very fine such that, for example, 10 lines fall within 1 mm, as described above, shadings at positions where a groove exists and at positions where a groove does not exist are averaged and recognized, so that a watermark-engraved image is recognized as usual.

According to the first embodiment, it becomes possible to produce an image card where an image formed of striped grooves is formed on a plate to be engraved which is composed of an opaque layer by engraving and an image formed by watermark engraving has been superimposed on the same plane as the image formed by striped grooves.

When the image card is observed as a watermark image or a reflective image from above an engraved face of the image card, the hidden image cannot be recognized.

Next, an image card composed of a transparent layer and an opaque layer will be explained as a second embodiment of the present invention.

Since a character pattern in this embodiment is completely the same as the character pattern formed of the striped grooves in FIG. 1, explanation thereof is omitted.

FIG. 3A shows an enlarged view of a section of a watermark-engraved image card which has been engraved according to the conventional art. An image card 120 includes an opaque layer 121 bonded to a transparent layer 123. In the image card composed of the transparent layer 123 and the opaque layer 121, engraving is performed from the side of the opaque layer 121, and observation of an image can be performed from both an engraved face and a back face thereof, but since the observation from the engraved face of the image card is the same as the case explained in FIG. 1B, an observation from the back side of the engraved face (the side of the transparent layer 123) will be explained in this embodiment.

Sections indicated by (x), (y) and (z) in FIGS. 3C and 3D are formed by performing engraving such that their thicknesses are different from one another. When the image card 120 is viewed from a viewpoint Ec in FIG. 3C, intensities of transmissive lights are different according to the thickness of the opaque layer 121 in the respective sections, so that an image whose concentration becomes deeper in the order of the sections (x), (y) and (z) is formed. Since the entire opaque layer 121 is scraped off in the section (x) by engraving, the section (x) transmits light the most and becomes bright.

FIG. 3D shows an example of an image card formed by combining striped grooves of an embodiment of the present invention with the watermark engraving of the conventional art.

An image card 130 is composed of a transparent layer 133 and an opaque layer 131, Striped grooves 135*x*, 135*y* and 135*z* extending from the front side of the sheet in a depth direction of the sheet are formed. These grooves are formed by scraping off the opaque layer 131 entirely in their depth directions by engraving until they reach the transparent layer 133.

When these grooves are observed from a viewpoint Ed perpendicular to an extending direction of the grooves, wall faces 135*w* of the striped grooves are mainly observed. Further, when the grooves are observed from a viewpoint (a position above the sheet) parallel to the extending directions of the grooves, bottom faces 115*b* of the striped grooves are mainly observed. The wall faces 115*w* and the bottom faces 115*b* of the striped grooves are made of the same opaque layer 111, but since there is a difference in light hitting aspect between the wall faces 115*w* and the bottom faces 115*b* due to the structure of the grooves so that a difference in contrast occurs therebetween, an image is formed by directions of the striped grooves.

Regarding the watermark-engraved image shown in FIG. 2B, concentration of the image is determined depending on an average value of areas of the grooves in a height direction. Since the widths of the grooves themselves are very fine such that, for example, 10 lines fall within 1 mm, as described above, shadings at positions where a groove exists and at positions where a groove does not exist are averaged and recognized, so that a watermark-engraved image is recognized as usual.

According to the second embodiment, it becomes possible to produce an image card where an image formed by striped grooves is formed on a plate to be engraved which is composed of a transparent layer and an opaque layer by engraving and a watermark-engraved image has been superimposed on the same plane as the image formed by striped grooves.

When the hidden image of the second embodiment is observed in a direction parallel to the striped grooves, a transmissive light is observed, so that luminance larger than that of the first embodiment can be obtained, and it becomes possible to further emphasize the hidden image.

In the abovementioned first and second embodiments, the examples where the hidden image formed of striped grooves and the image formed by watermark-engraving have been formed in a superimposing manner have been explained, but a method for forming the hidden image formed of striped grooves without superimposing it on the watermark-engraved image may be adopted, of course. In the case, when the hidden image is viewed from above in a watermark manner, it is recognized as an even concentration.

In the embodiments of the present invention, the example of the image obtained by expressing the shading of the image as binary and allocating two striped patterns crossing at an angle of 90° to respective values of the binary has been shown, but the shading of the image is not limited to the binary and it can take ternary or higher values (for example, 256 values expressed by 8 bits), where it is made possible to show various images by changing the angle of a viewpoint.

As shown in the embodiments of the present invention, an image formed on the image card may be a character, a photograph image, or a figure.

The opaque layer is a layer which is not transparent but transmits light, where an attenuation rate of the transmitted light varies according to the thickness of the layer and watermark engraving can be performed.

An image card (a plate to be engraved) embedded with a hidden image formed of striped grooves whose angles have been made different will be first explained.

FIG. 1 is a view of the image card as viewed vertically from above.

In FIG. 1, an alphabetical character "A" is depicted, where a character portion is formed by a striped pattern formed by striped grooves extending in horizontal direction and a non-character portion is formed by a striped pattern extending in vertical direction. Since the striped pattern extending in horizontal direction and the striped pattern extending in vertical direction are formed such that their line widths are equal to each other and their distances between adjacent lines are equal to each other, image concentrations thereof are the same. When the image is viewed from a position separated by a distance where a line pattern of the image is vague, it becomes difficult to determine what pattern is written on the image.

In engraving performed by an actual image engraving device, since it is possible to form ten lines within a width of 1 mm, an image obtained by the image engraving device is such a fine image that a lateral width of an entire rectangle including the character shown in FIG. 1 falls within 13 mm, and it is difficult to recognize the image of the "A" character with naked eyes from above, so that the obtained image configures a hidden image.

However, it becomes possible to determine the character when the image is observed from directions parallel to the respective striped patterns in an oblique direction.

Next, an image engraving device according to a third embodiment of the present invention will be explained below.

Figure 4:
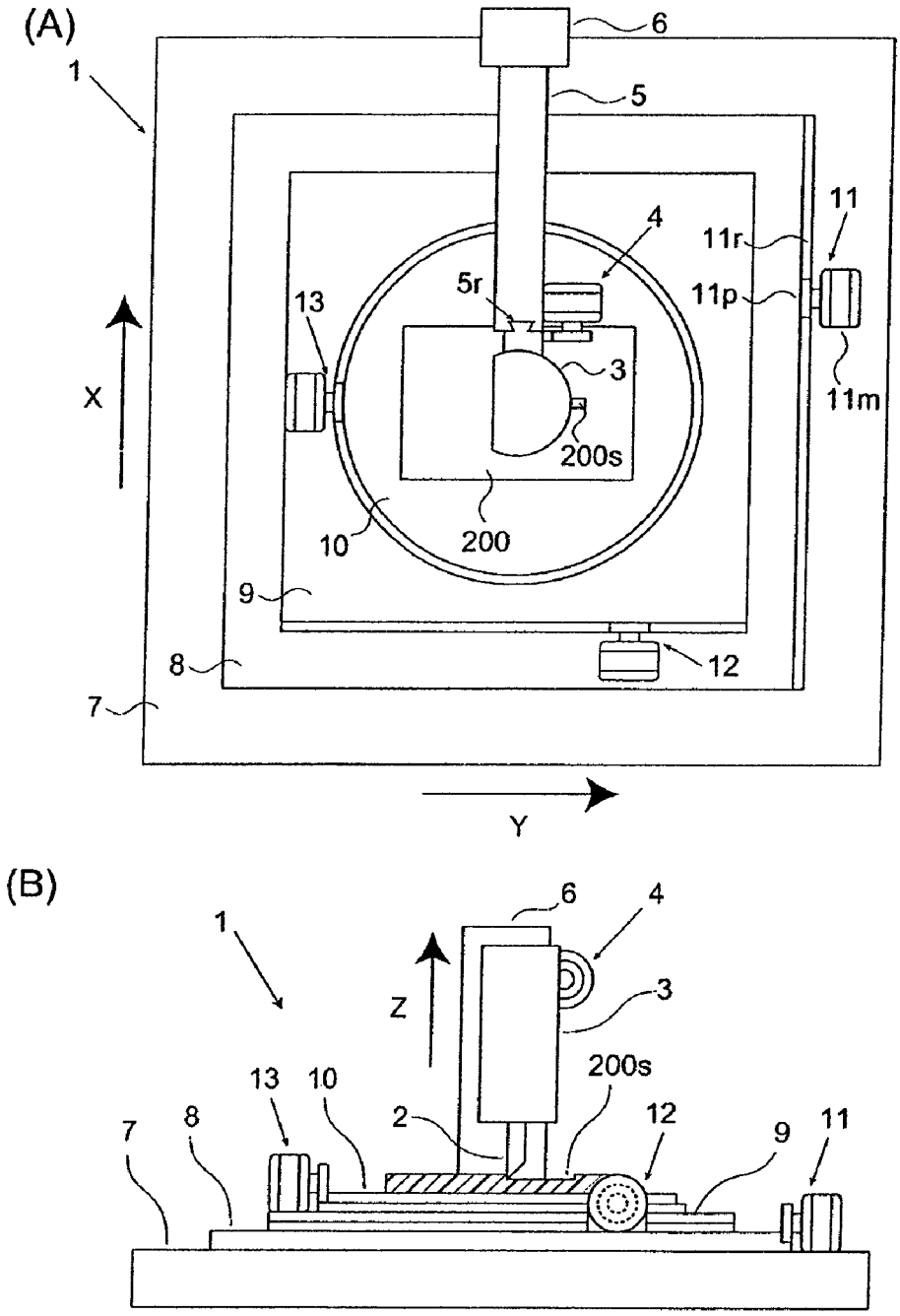
FIGS. 4(A) and 4(B) are a plan view and a side view of an image engraving device according to the third embodiment of the present invention, respectively.

FIGS. 4A and 4B are a plan view (4A) and a side view (4B) of an image engraving device 1 according to the embodiment of the present invention.

The image engraving device 1 is provided with an engraving needle 2, an engraving needle supporting rod 3, an engraving needle driving unit 4, an engraving needle supporting bridge 5, an engraving needle supporting column 6, an engraving device supporting base stand 7, an X-direction moving stage 8, a Y-direction moving stage 9, a rotating stage 10, an X-direction driving unit 11 (the plate driving unit), a Y-direction driving unit 12 (the plate driving unit), and a rotary driving unit 13.

An image card 200 which is the plate is fixed on the rotating stage 10 of the image engraving device 1, and a sectional view of an image card 200 is shown in a side view in FIG. 1B, showing a slit 200*s* which has been formed by the engraving needle 2 according to movement of the Y-direction moving stage 9 in a direction indicated by arrow Y in FIG. 4A.

The engraving needle 2 has a blade edge made of diamond or cemented carbide at its distal end and it performs engraving by scraping off a surface of the image card 200.

The engraving needle supporting rod 3 can support the engraving needle 2 to move the same in a vertical direction by the engraving needle driving unit 4.

The engraving needle driving unit 4 is fixed to the engraving needle supporting bridge 5 and drives the engraving needle supporting rod 3 in a vertical direction to adjust a depth direction where engraving is performed (a direction indicated by arrow Z axis).

The engraving needle supporting bridge 5 is fixed to the engraving needle supporting column 6 to serve as a base for the engraving needle driving unit 4. The engraving needle supporting bridge 5 and the engraving needle supporting rod 3 are coupled to each other by an engraving needle rail mechanism 5*r* so that the engraving needle supporting rod 3 can be slid in a vertical direction by the engraving needle driving unit 4.

The engraving needle supporting column 6 is fixed to the engraving needle supporting base stand 7 to support the engraving needle supporting bridge 5.

The image engraving device supporting base stand 7 is a base stand fixing the image engraving device 1.

The X-direction moving stage 8 is a stage (a base stand) which can be moved in an X-axis direction indicated by arrow X by a rail mechanism (not shown) similar to the engraving needle rail mechanism 5*r* on the image engraving device supporting base stand 7.

The Y-direction moving stage 9 is a stage (a base stand) which can be moved in a Y-axis direction indicated by arrow Y by a rail mechanism (not shown) similar to the engraving needle rail mechanism 5*r* on the Y-direction moving stage 8.

The rotating stage 10 is a rotatable stage (a base stand) which is pivotally supported on the Y-direction moving stage 9 by a rotating mechanism arranged at a lower portion of the rotating stage 10. The image card 200 which is the plate is fixed on the rotating stage. As a fixing method, the image card 200 is fixed by vacuum contact from fine holes opened on the rotating stage 10 or the like.

The X-direction driving unit 11 (the plate driving unit) is a moving mechanism unit which moves the X-direction moving stage in the X-axis direction. The X-direction driving unit 11 is composed of a driving stepping motor 11*m*, a pinion 11*p* attached to a rotary shaft of the motor, a rack 11*r* attached to an edge of the X-direction moving stage 8, and a rail mechanism (not shown) attached to a lower portion of the X-direction moving stage 8.

The Y-direction driving unit 12 (a plate-to-be-engraved driving unit) is a moving mechanism unit which moves the Y-direction moving stage in the Y-axis direction. The Y-direction driving unit 12 is composed of a motor, a rack and a pinion, and a rail mechanism similar to those of the X-direction driving unit 11.

The rotary driving unit 13 is a mechanism unit which rotates the rotating stage 10, and it is composed of a motor, a rack and a pinion similar to those of the X-direction driving unit 11, and a rotating mechanism which pivotally supports the rotating stage and is arranged at a lower portion of the rotating stage.

Figure 5:
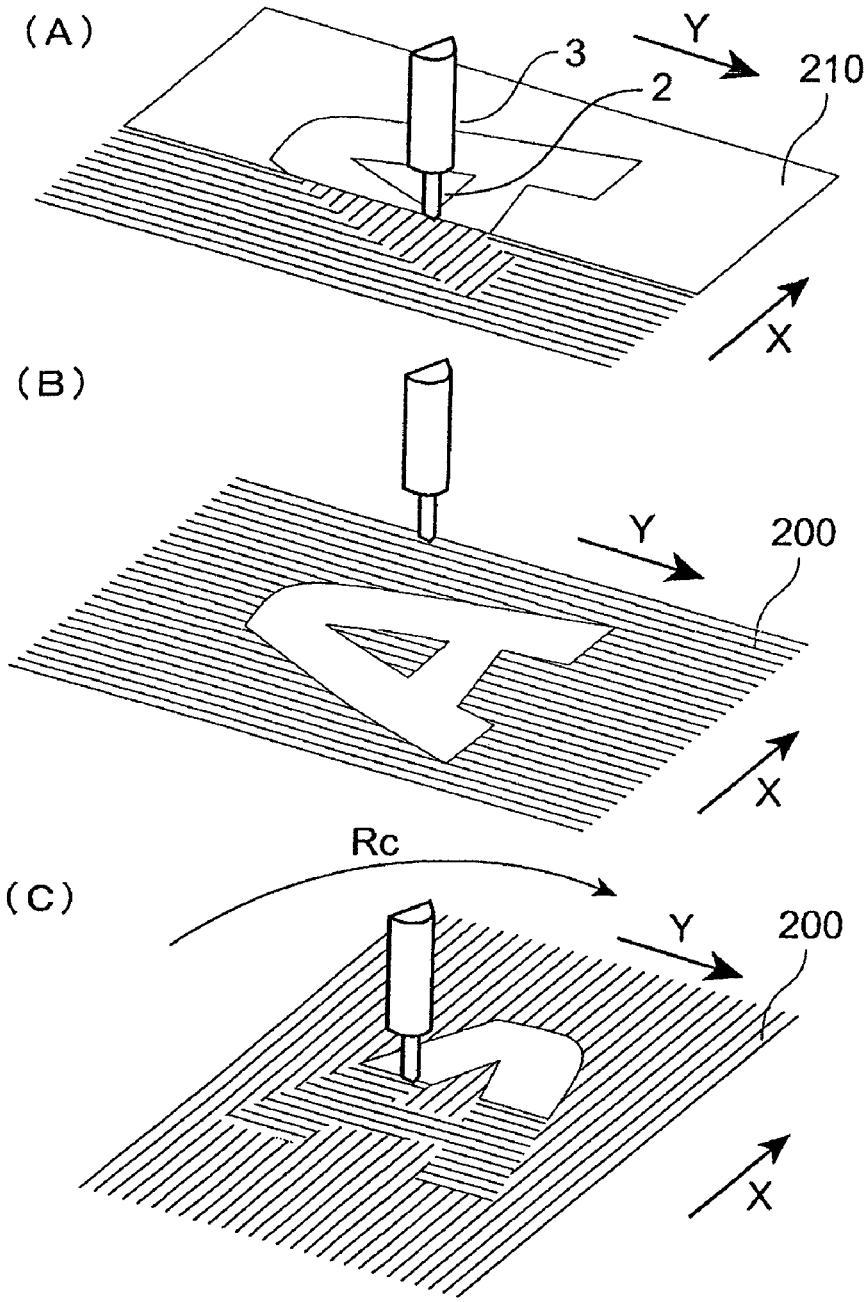
FIGS. 5(A) to 5(C) show a difference between methods for producing the image cards with a conventional image engraving device (FIG. 5A) and an image engraving device according to the third embodiment of the present invention (FIG. 5B) (FIG. 5C)

With reference to FIG. 5A, an engraving method performed by a conventional image engraving device which does not include the rotary driving unit will be explained.

In FIG. 5A, an engraving method of the alphabetical character "A" shown in FIG. 1 will be explained.

The engraving needle 2 which performs engraving and the engraving needle supporting rod 3 are disposed at central portions in FIGS. 5A, 5B and 5C. When engraving is performed, the engraving is performed from the left side of the A image by sweeping the plate with the engraving needle and an image card 210 is moved in a direction indicated by arrow Y, so that a surface of the image card is scraped off by the engraving needle 2 and a groove is formed on the surface.

Since the conventional image engraving device shown in FIG. 5A does not include the rotary driving unit, when the character portion is formed, the scanning direction of the engraving and the groove direction of the character do not coincide with each other, so that working is performed while the engraving needle is moved up and down for each of the tops of the grooves. As a result, a large difference in quality regarding formation of a wall face or a bottom face of the groove occurs between a groove which coincides with the scanning direction (a portion other than the character) and a groove which is perpendicular to the scanning direction (the character portion), so that such a phenomenon occurs that a wall face or a bottom face is undulated in a portion where the scanning direction of the engraving and the groove direction of the character do not coincide with each other.

Figure 6:
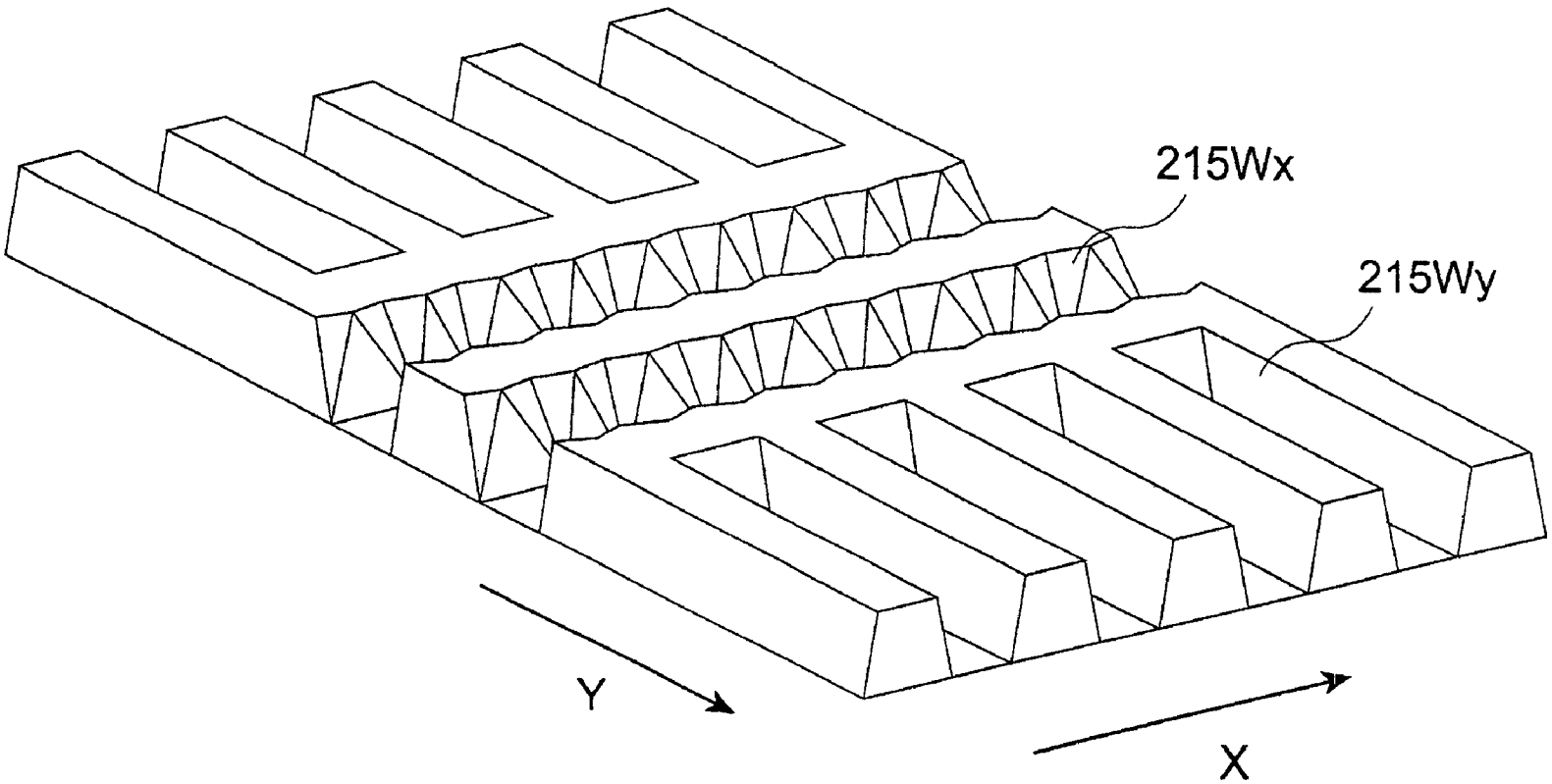
FIG. 6 is a schematic explanatory diagram of groove shapes obtained when a hidden image is engraved by the conventional image engraving device.

FIG. 6 shows an enlarged view of grooves formed. Though a groove is formed by movement in a Y-axis direction in FIG. 6, a wall face 215Wy of a groove where the extending direction of the groove and the engraving direction coincide with each other is linearly formed cleanly, but undulation occurs on a wall face 215Wx of a groove where the extending direction of the groove and the engraving direction are deviated from each other by an angle of 90°.

A similar effect occurs on not only the wall face but also the bottom face of the groove, as a result, the shape of the groove varies according to an angle of the extending direction of the groove, so that, though it is desired originally as a hidden image that a hidden image cannot be confirmed from above, but the hidden image can be viewed by observation performed from above.

On the other hand, since the image engraving device 1 according to the embodiment of the present invention includes the rotating stage 10 and the rotary driving unit 13, it is possible to cause the extending direction of the groove and the engraving direction to coincide with each other.

An actual engraving procedure will be explained with reference to FIGS. 5B and 5C. First, as shown in FIG. 5B, engravings of grooves to portions of the image card 200, where the groove direction and the engraving direction coincide with each other, except for the character are sequentially performed from the left side of the image by sweeping the plate with the engraving needle Next, as shown in FIG. 5C, the image card 200 is rotated in a direction indicated by rotation arrow Rc by an angle of 90° by the rotary driving unit and engraving work is performed while causing the striped grooves of the character portion (a portion "A") and the engraving direction to coincide with each other.

Figure 7:
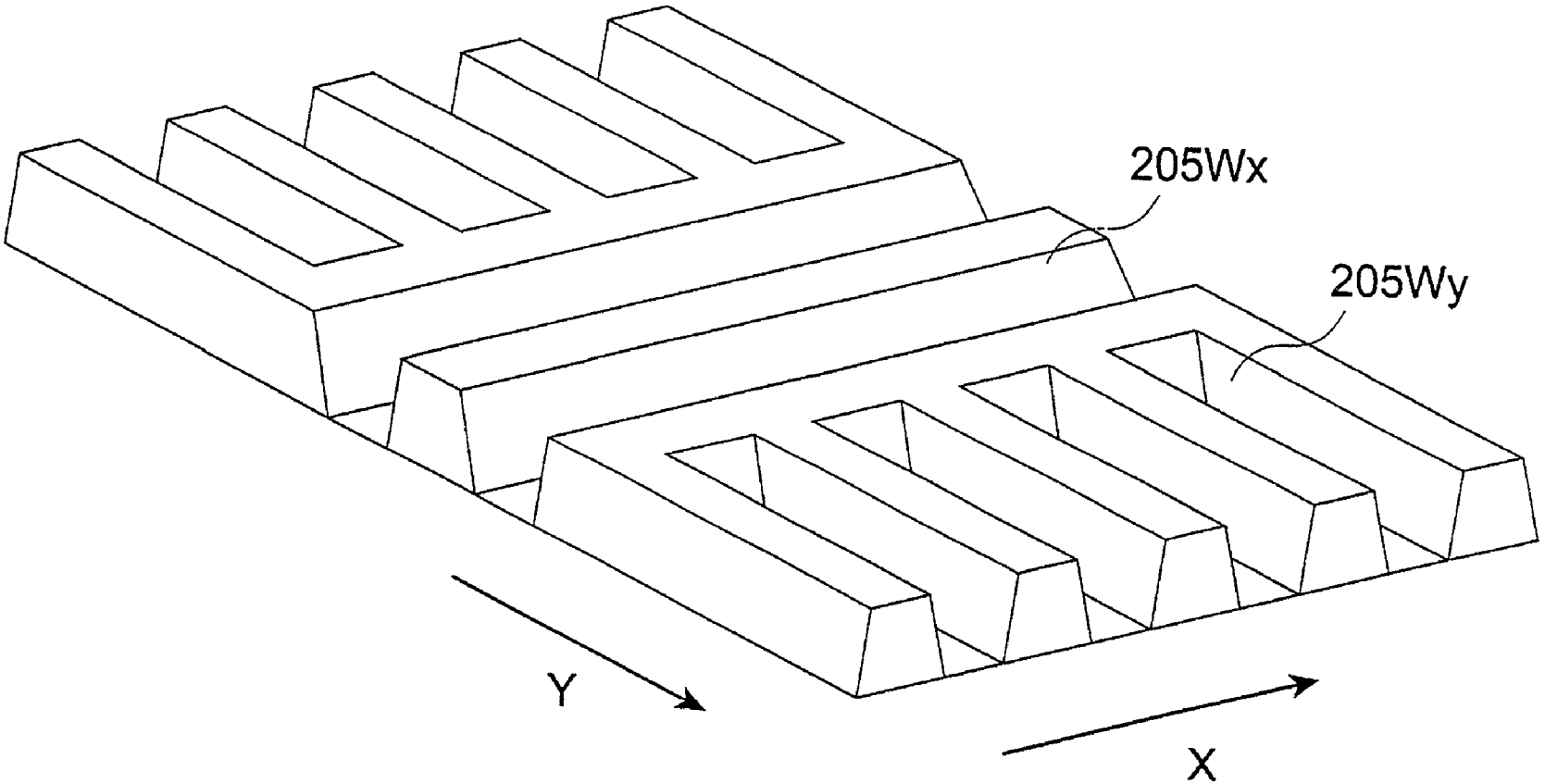
FIG. 7 is a schematic explanatory diagram of groove shapes obtained when a hidden image is engraved by the image engraving device according to the third embodiment of the present invention.

An enlarged view of grooves formed by engraving according to the method shown in FIGS. 5B and 5C is shown in FIG. 7.

A wall face 205Wy of a groove extending in a Y-axis direction in FIG. 7 and a wall face 205Wx of a groove extending in an X-axis direction can be formed as wall faces which do not include undulation, since the engraving direction of the engraving needle 2 and the extending direction of the groove are the same.

According to the image engraving device according to the third embodiment of the present invention, when striped grooves whose angles are made different are formed, the rotary driving unit is rotated so as to accommodate an angle of the striped groove and the groove is then formed by moving the image card according to a movement of the driving unit in the horizontal direction, so that the extending direction of the groove and the engraving direction of the groove become equal to each other, whereby shapes of the side face and the bottom face of the groove can be finished evenly. Further, necessity of driving the engraving needle in the vertical direction is reduced, so that it becomes possible to reduce working time. Furthermore, jaggies (undulation) are prevented from being generated on a side face of the groove of the image, so that image precision is improved remarkably.

In the third embodiment of the present invention, the example of the hidden image obtained by expressing the shading of the image by binary and allocating two striped patterns crossing at an angle of 90° to respective values of the binary has been shown, but the shading of the image is not limited to the binary and it can employ ternary or higher values (for example, 256 values expressed by 8 bits), where it is made possible to show various images by changing the angle of a viewpoint.

As shown in the third embodiment of the present invention, an image formed on the image card may be a character, a photograph image, or a figure.

The image engraving device 1 shown in the third embodiment of the present invention has such a configuration that the driving stages and the driving mechanisms accompanied thereby are stacked in the order of the Y-direction driving stage, the X-direction driving stage, and the rotationally driving stage from the base stand side, but it is not limited to this configuration and it can adopt such a configuration that the rotary driving unit is positioned at the lowermost position, or it can adopt such a configuration that the X-direction driving stage and the Y-direction driving stage are arranged in the inverted order. Further, an device which forms grooves on an image card at different angles thereof by sweeping the plate with the engraving needle utilizing a combination of the rotary driving unit and the horizontally driving units, even if the device includes another different mechanism, can be adopted.

The invention claimed is:

1. An image engraving device comprising an engraving needle driving unit driving an engraving needle in a vertical direction and a plate driving unit driving a plate to be engraved in a horizontal direction to perform engraving on the plate by sweeping the plate with the engraving needle through relative movement between the engraving needle and the plate, the device further comprising:

a rotary driving unit rotating the plate in a horizontal direction, to form striped grooves by performing engraving on the plate rotated at a given angle by sweeping the plate with the engraving needle.

2. The image engraving device according to claim 1, wherein the rotary driving unit rotating the plate such that an extending direction of the striped grooves and a direction of engraving performed by the engraving needle coincide with each other.

3. The image engraving device according to claim 1, wherein a hidden image is engraved by forming the striped grooves having different angles according to the degree of shading of the image on the plate to be engraved.

4. The image engraving device according to claim 3, wherein the shading of the image is expressed by binary and the hidden image is engraved by striped grooves orthogonal to each other that express the shading of the binary.

* * * * *